US012584249B2

(12) United States Patent
Poirier et al.

(10) Patent No.: US 12,584,249 B2
(45) Date of Patent: Mar. 24, 2026

(54) TEARABLE CLOTH

(71) Applicants: Ningbo Xinrun Textile Co., Ltd., Cixi City (CN); Roemar, Inc., Southborough, MA (US)

(72) Inventors: Robert Poirier, Southborough, MA (US); Buyi Cen, Cixi (CN); Jieyuan Cen, Cixi (CN); Lijun Lin, Cixi (CN); Chenxin Fei, Cixi (CN)

(73) Assignees: Ningbo Xinrun Textile Co., Ltd., Cixi City (CN); Roemar, Inc., Westborough, MA (US)

( * ) Notice: Subject to any disclaimer, the term of this patent is extended or adjusted under 35 U.S.C. 154(b) by 267 days.

(21) Appl. No.: 18/126,064

(22) Filed: Mar. 24, 2023

(65) Prior Publication Data

US 2024/0026579 A1 Jan. 25, 2024

(30) Foreign Application Priority Data

Mar. 24, 2022 (CN) ..... 202220664123.5

(51) Int. Cl.

| | |
|---|---|
| ***D03D 15/573*** | (2021.01) |
| ***D03D 27/04*** | (2006.01) |
| ***D03D 27/08*** | (2006.01) |

(52) U.S. Cl.

CPC ..... *D03D 15/573* (2021.01); *D03D 27/04* (2013.01); *D03D 27/08* (2013.01); *D10B 2401/04* (2013.01)

(58) Field of Classification Search

CPC ..... A47K 10/16; A47K 10/02; Y10T 428/15

See application file for complete search history.

(56) References Cited

U.S. PATENT DOCUMENTS

| | | | |
|---|---|---|---|
| 2,121,162 | A | 6/1938 | Riley |
| D352,630 | S | 11/1994 | Yamanaka |
| D358,520 | S | 5/1995 | Yamanaka |
| 5,605,731 | A | 2/1997 | Guasch Pubill |
| 5,616,387 | A | 4/1997 | Augst et al. |
| D382,118 | S | 8/1997 | Ferrero |
| 6,120,629 | A | 9/2000 | Shannon et al. |
| D459,897 | S | 7/2002 | Bredendick et al. |
| D481,872 | S | 11/2003 | Hennel et al. |
| D546,010 | S | 7/2007 | Caruso et al. |
| D578,309 | S | 10/2008 | Johnston et al. |

(Continued)

FOREIGN PATENT DOCUMENTS

| | | |
|---|---|---|
| CN | 1400096 A | 3/2003 |
| CN | 202148393 U | 2/2012 |

(Continued)

OTHER PUBLICATIONS

Bottcher et al., Ultrasonic welding of knitted fabrics. China Academic Journal, Electronic Publishing House. pp. 54-56, (1994-2015).

(Continued)

*Primary Examiner* — Alicia J Weydemeyer

(74) *Attorney, Agent, or Firm* — Wolf, Greenfield & Sacks, P.C.

(57) ABSTRACT

A continuous cloth comprising a meltable material comprises one or more cloth units having separation portions therebetween, wherein cloth material of the separation portions has been hot melted, facilitating separation of adjacent cloth units at the respective separation portion therebetween.

28 Claims, 3 Drawing Sheets

(56) References Cited

U.S. PATENT DOCUMENTS

| | | | | |
|---|---|---|---|---|
| D642,759 | S | 8/2011 | Otsuka et al. | |
| D821,784 | S | 7/2018 | Can | |
| D830,737 | S | 10/2018 | Can | |
| D832,620 | S | 11/2018 | Daley et al. | |
| D935,232 | S | 11/2021 | Tang | |
| D987,325 | S | 5/2023 | Cen | |
| 12,209,354 | B2 | 1/2025 | Cen et al. | |
| 2001/0044249 | A1 | 11/2001 | Demott et al. | |
| 2006/0093788 | A1 | 5/2006 | Behm et al. | |
| 2006/0147669 | A1 | 7/2006 | Mano et al. | |
| 2008/0251214 | A1 | 10/2008 | Chen | |
| 2014/0057069 | A1 | 2/2014 | Huang et al. | |
| 2016/0345761 | A1 | 12/2016 | Olson et al. | |
| 2020/0040491 | A1* | 2/2020 | Mittal | D03D 15/47 |
| 2020/0054156 | A1* | 2/2020 | Chang | A47G 23/0303 |
| 2020/0147636 | A1 | 5/2020 | Rammelkamp | |
| 2023/0304214 | A1* | 9/2023 | Cen | B32B 5/026 |
| 2025/0171952 | A1 | 5/2025 | Poirier et al. | |

FOREIGN PATENT DOCUMENTS

| | | | |
|---|---|---|---|
| CN | 106400260 | A | 2/2017 |
| CN | 210095644 | U | 2/2020 |
| CN | 112195639 | A | 1/2021 |
| CN | 213949400 | U | 8/2021 |
| CN | 214168554 | U | 9/2021 |
| CN | 215899507 | U | 2/2022 |
| CN | 115444300 | A | 12/2022 |
| CN | 219137249 | U | 6/2023 |
| JP | 3195491 | B2 | 8/2001 |
| JP | 2003-527264 | A | 9/2003 |
| JP | 2005-125719 | A | 5/2005 |
| JP | 2006-207098 | A | 8/2006 |
| JP | 2009-112781 | A | 5/2009 |
| TW | 202009343 | A | 3/2020 |

OTHER PUBLICATIONS

Jiang et al., Mechanical properties of ultrasonically stitched polyester fabric seams. Journal of Textile Research. Oct. 2013;34(10):127-130.

Liu, On the Development of Knitted Terry Fabrics. China Academic Journal, Electronic Publishing House. pp. 25-30 (1994-2016).

Niu, The Role of Lu Shi in the Textile Industry and Fusion Technology. China Academic Journal, Electronic Publishing House. pp. 34-35, (1994-2015).

Song et al., Study on the Wearing Comfort Performance of Conventional Terry Fabric. Journal of Yancheng Institute of Technology (Natural Science Edition). Jun. 2013;26(2):59-62.

Taiwan Patent Application No. 107128859, Shienq Huong Enterprise Co., Ltd. Aug. 17, 2018, 50 pages.

International Search Report and Written Opinion for Application No. PCT/US2023/016255, dated Jun. 14, 2023, 9 pages.

Kohler et al., Static ultrasonic welding of carbon fibre unidirectional thermoplastic materials and the influence of heat generation and heat transfer. Journal of Composite Materials. Jan. 7, 2021;55(15):2087-2102.

Pine Crest Fabrics, Knit Fabric. Retrieved online at: <https://pinecrestfabrics.com/fabric-knowledge/knit-fabric.> 8 pages, (2021).

International Search Report and Written Opinion, mailed May 29, 2023, for Application No. PCT/CN2023/081216.

International Preliminary Report on Patentability, mailed Oct. 3, 2024, for Application No. PCT/CN2023/081216.

International Search Report and Written Opinion, mailed Jun. 14, 2023, for Application No. PCT/US2023/016255.

International Preliminary Report on Patentability, mailed Oct. 3, 2024, for Application No. PCT/US2023/016255.

[No Inventor Listed], Continuous Polyester Fiber Textile Cloth, Processing Equipment and Method. Co-pending U.S. Appl. No. 90/015,347, filed Jun. 27, 2025.

* cited by examiner

TEARABLE CLOTH

CROSS-REFERENCE TO RELATED APPLICATIONS

This application claims benefit under 35 U.S.C. § 119(a)-(d) to Chinese Patent Application no. 202220664123.5 filed Mar. 24, 2022, which is hereby incorporated by reference in its entirety as part of the present disclosure.

FIELD OF THE INVENTION

The invention relates to a cloth, and in particular, to a continuous cloth that has one more separation portions thereon. Pieces of the cloth can be separated from the continuous material by tearing along the separation portions.

BACKGROUND

Cloths and towels are widely used for drying, cleaning, wiping and washing, etc. A common material used in cloths is a polyester fiber textile material. Such cloths can include a base layer and a looped pile or terry on at least one side of the base layer. To make such cloths, polyester yarns and/or polyester-polyamide yarns are woven into a greige cloth by a warp weaving or weft weaving process, and the fabric is dyed.

Such fiber fabrics are difficult to tear by a user. Thus, to produce towels or cloths, a manufacturer can produce a large continuous cloth and then cut individual pieces out of the cloth, and then shape them into the towel cloth, wiping cloth, mop cloth, etc. to be used by a user. To package the cloths, they typically must first be stacked to be placed into the packaging.

For the manufacturer, the above production and packaging methods are complex and the production cost is high. For the user, the product is not always convenient to use.

SUMMARY

In view of the inconvenience of the above-discussed cloths with respect to production and packaging as well as a user's use, the inventors have invented a cloth formed with separation portions, the material of which has been heated and melted, e.g., forming molten masses, to decrease the tear strength of the separation portions relative to adjacent material to facilitate tearing by a user. Accordingly, independent single pieces of the cloth can be separated by tearing along the separation portions. In order to facilitate storage and use of the cloth, it may be rolled into a roll.

In at least some embodiments, the material in the separation portions is not broken through a thickness of the cloth. In other embodiments, the separation portions are formed by heating, melting and compressing the meltable material of the separation portions, which may comprise, for example, a polyester or polyester blend material. In at least some of these embodiments, the cloth comprises a base layer woven from yarns and a terry layer located on one or both sides of the base layer, and the separation portions are formed by heating and melting and, where applicable, compressing the base layer and the terry layer. In some embodiments, the heating and melting is performed ultrasonically, e.g., via high frequency ultrasonic.

In further embodiments, the separation portions define a first thickness that is less than a thickness of cloth material adjacent thereto, and may be less than or equal to the thickness of the base layer. The first thickness may be, for example, about 0.01 mm-about 2 mm. In yet further embodiments, wherein the separation portions define a recess or groove in the cloth relative to cloth material adjacent thereto.

In at least some of the above-discussed embodiments, the separation portions define one or more cloth units, wherein the separation portions connect adjacent cloth units and/or each cloth unit is separable from the cloth by tearing the cloth at respective separation portions adjacent said each cloth unit. The cloth units in some embodiments define a length of about 5 cm-about 200 cm. The separation portions defining such cloth units may be located at intervals along a length direction of the cloth and may traverse a width of the cloth, and comprise straight, curved, zigzag or bent lines.

In at least some embodiments, after tearing, a portion of the melted material of torn separation portion remains attached to the adjacent cloth material. This closes or seals the edge and prevents fraying of the cloth material. Similarly, the untorn edges of the cloth may be edge-cut by hot melting to prevent fraying.

Another aspect includes a method of making a cloth. The method includes forming, in a continuous cloth material formed with meltable material, one or more separation portions, including heating and melting said meltable material to form the separation portions with a tear strength that is less than a tear strength of cloth material adjacent the separation portions, such that the cloth tears more easily at the separation portions than at said cloth material adjacent said separation portions. The heating and melting may be done ultrasonically, such as by using high frequency ultrasonic. In some embodiments, the material at the separation portions is compressed after being heated and melted.

In additional embodiments, the separation portions are formed so that the material in them not broken through the thickness of the cloth. In further embodiments, the separation portions are formed to have a first thickness that is less than a thickness of cloth material the separation portions, and/or define a recess or groove in the cloth relative to cloth material adjacent thereto. The first thickness may be about 0.01 mm-about 2 mm. In embodiments where the cloth comprises a base layer and a looped pile layer attached to the base layer, the first thickness can be less than or equal to the thickness of the base layer.

Furthermore, the method may include rolling the cloth into a roll, which may facilitate storage and use of the cloth.

Compared with previous cloths, the invention has the advantages that the cloth is tearable and dividable into multiple cloth units via the separation portions, where the heating, melting, and, in applicable embodiments, the compressing, makes the material in the separation portions more brittle and less tough, and also damages the connections between the fibers of the base layer and between the terry/loop pile portions and the base layer. In addition, in embodiments in which separation portions are thinner than or define recesses or grooves in the cloth, they form stress notches and concentration that cause the separation portions to more easily break.

Thus, independent single pieces of cloth can be easily separated by a user by tearing along the separation portions, thus facilitating the user to use the textile cloth according to personalized need, and also facilitating centralized storage of a large number of single pieces of cloth, including in rolled form.

Other objects and advantages of the present invention will become apparent in view of the following detailed description of the embodiments and the accompanying drawings.

BRIEF DESCRIPTION OF THE DRAWINGS

Embodiments will be described below with reference to the drawings. However, those skilled in the art should appreciate that the drawings are only for the purpose of explaining the described embodiments, and therefore do not limit the scope of the invention or the claims herein. In addition, unless otherwise indicated, the drawings are intended only to conceptually represent the described embodiments, and are not necessarily drawn to scale.

DETAILED DESCRIPTION

Embodiments are described below with reference to the drawings. It should be noted that like numerals in separate drawings represent like items. Therefore, once a certain item in a drawing is described, it might not be further defined and explained in the subsequent drawings. In addition, it should be noted that orientations, positions and relationships discussed herein, e.g., terms such as "front", "rear" and the like, are provided solely to facilitate the description of the respective embodiment, and do not indicate that a particular orientation is required, or that the invention must be configured and/or operated in the particular orientation, and thus should not be construed as limiting the scope of the invention and claims herein.

Figure 1:
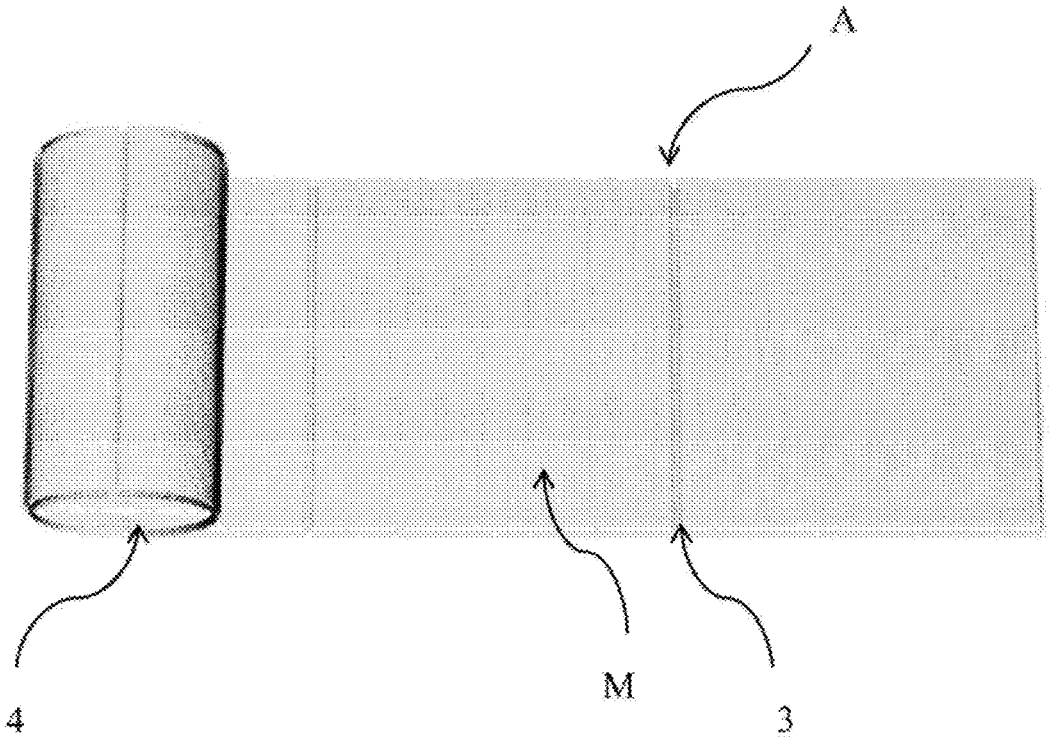
FIG. 1 is a schematic view of a rolled cloth.
Figure 2:
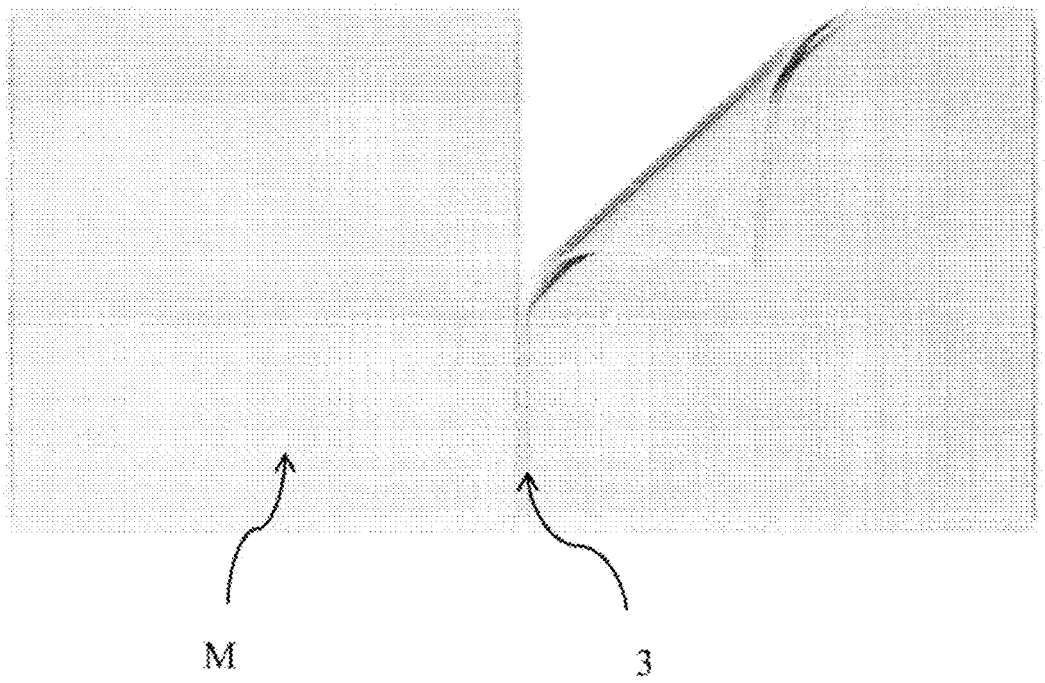
FIG. 2 is a partial schematic view of the rolled cloth of FIG. 1 during a process of tearing a portion of the cloth from the roll.
Figure 3:
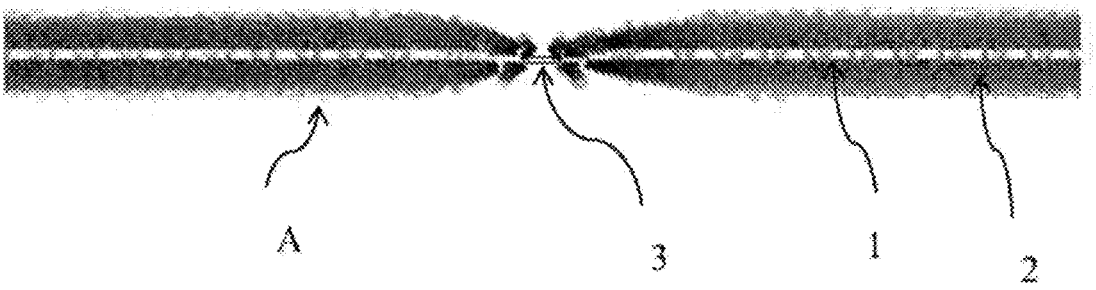
FIG. 3 is a partial sectional view of the cloth of FIG. 1.

FIGS. 1-3 show a continuous cloth "A" that can be torn into pieces. The cloth is formed of a meltable material, such as, for example, a polyester fiber textile cloth. In this embodiment, the cloth "A" comprises a base layer 1 woven from yarns, and a looped pile or terry layer 2 located on both sides of the base layer, though in other embodiments the terry layer 2 is located on only one side of the base layer 1.

Figure 4:
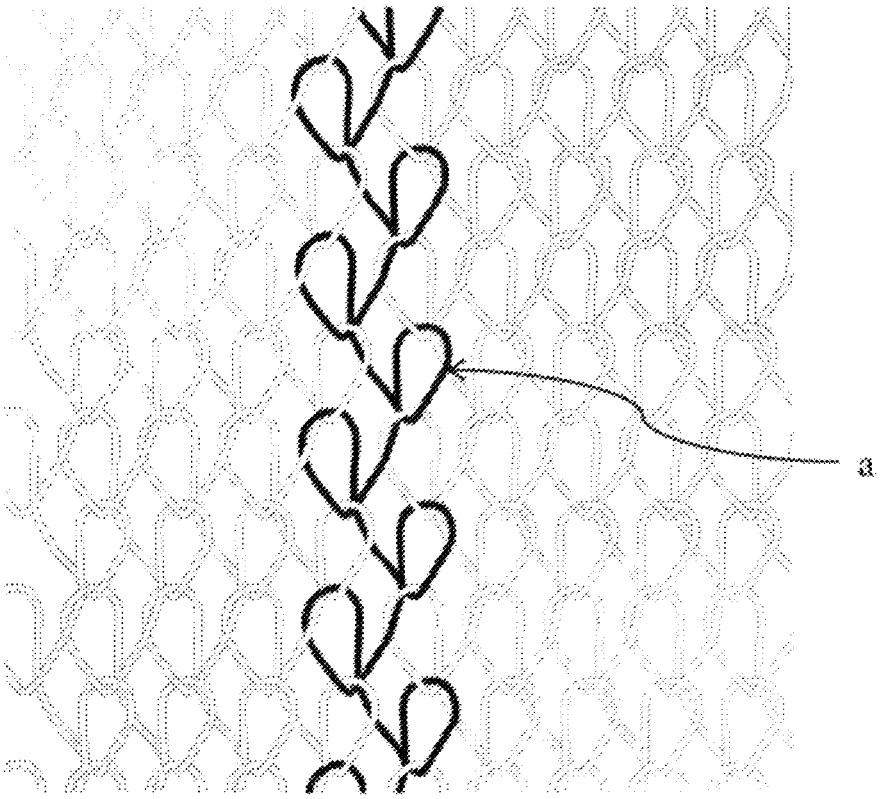
FIG. 4 is a schematic view of a base layer of the cloth of FIG. 1 formed by a warp weaving process.

As shown in FIG. 4, the base layer 1 is formed by a warp weaving process contain ring units "a" formed of yarns or threads. The ring units "a" are interlocked. One end of the ring unit of the weft yarn passes through a ring unit of an adjacent weft yarn, and the other end is looped to form a ring unit at a diagonal position. Thus, adjacent ring units are interwoven to be connected.

Figure 5:
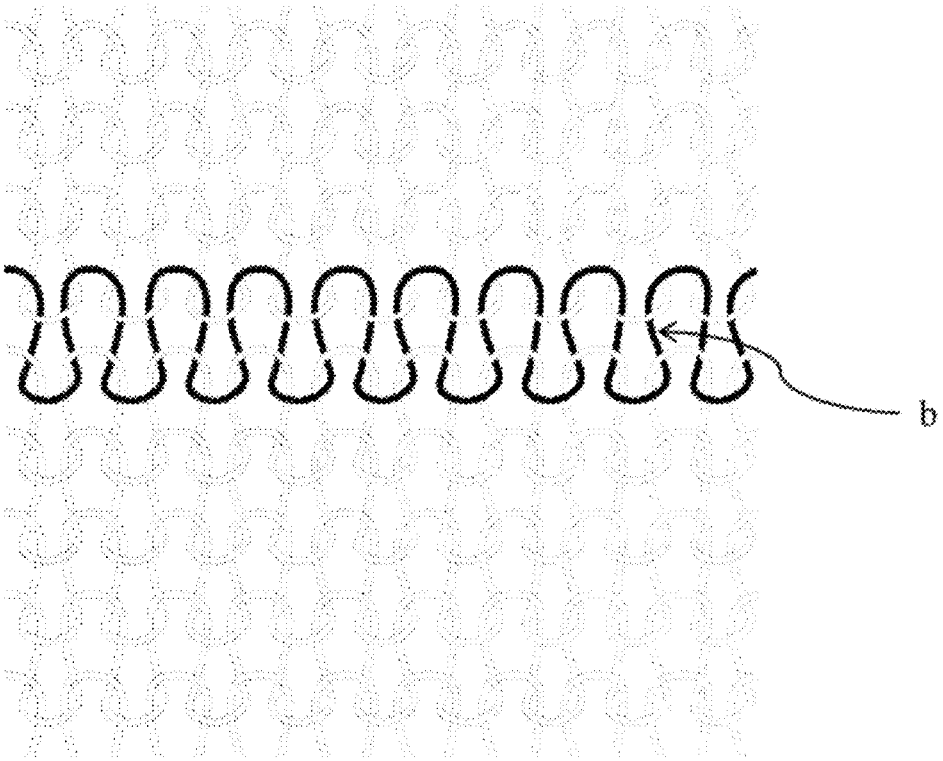
FIG. 5 is a view of a base layer of a cloth formed by a weft weaving process.

In the embodiment depicted in FIG. 5, the base layer 1 is formed by a weft weaving process. In this embodiment, the base layer 1 contains semi-ring units "b" composed of yarns or threads. Here, the woven yarn of the base layer 1 is bent in a wavy shape, forming adjacent semi-ring units "b" alternating in opposite directions located at intervals in the weft. Thus, semi-ring units formed by adjacent weft yarns are interwoven with each other.

In each embodiment, the interwoven yarns or threads make the base layer 1 tear resistant, thus making the cloth more durable.

The woven terry units of the terry layer 2 protrude out of the surface of the base layer 1 and are arranged on the surface of the base layer 1 in a matrix-like manner. Each terry woven unit is further interwoven with a ring unit "a" or semi-ring unit "b," as applicable, of the base layer 1, such that the base layer 1 and the terry layer 2 are bonded, which improves the strength of the cloth while improving its liquid absorption and cleaning ability.

As shown in FIGS. 1-3, the cloth has multiple separation portions 3 arranged at multiple locations on the cloth "A," dividing the cloth "A" into a plurality of cloth units "M." In the illustrated embodiment, the separation portions 3 are located at intervals in the length direction of the roll and traverse the width of the cloth. Other embodiments have further separation portions extending so as to intersect each other to form a grid of cloth units "M."

The separation portions 3 are formed by heating, melting and compressing fibers in the base layer 1 and the terry layer 2 at the locations of separation portions 3, which cool to form molten masses of material. It should be understood that the material in the separation portions 3, though it has been melted, is not broken. There is no gap or hole through the thickness of the molten mass of cloth "A" and the separation portion 3 connects adjacent cloth units "M." The heating of the cloth material, along with compressing it, decreases the toughness and increases the brittleness of the fibers at the locations of the separation portions 3. Further, the connections between the terry units and the base layer 1 at respective positions are damaged. Accordingly, the cloth "A" has decreased strength at the separation portions 3, allowing a user to tear or otherwise separate the cloth at or along a separation portion 3 more easily than tearing the unheated material itself. Thus, the user can remove one or more cloth units "M" from the roll as desired without using a knife or sharp blade. The user can remove a portion from the cloth from the roll in a desired size and shape, for example, based on the size of the object to be cleaned, by selectively tearing separation portions so as to provide such.

As seen in FIG. 3, the separation portions 3 are thinner than the surrounding unheated cloth material. In at least some embodiments, the thickness of the separation portions 3 is less than or equal to that of the original base layer 1. In the illustrated embodiment, the thin linear molten masses 3 are recessed relative to the surface of the cloth "A." The decreased thickens and/or recessing provides a stress concentration at the separation portion 3, which further facilitates breaking or tearing the cloth at that location. Such also helps a user visually locate the locations of the separation portions 3.

In the illustrated embodiment, the separation portion 3 is straight or linear. However, it may alternatively be curved, zigzag or bent. In the illustrated embodiment, the separation portions 3 are located so as to divide the cloth "A" into cloth units "M" of the same size.

In at least some embodiments, the base layer 1 contains polyester. In some such embodiments, the base layer 1 is pure polyester. In some embodiments, the material of the terry layer 2 is blended polyester comprised of polyester and polyamide. In terms of proportions of the yarns, the blended polyesters may be 80% polyester and 20% polyamide. It may also be 85% polyester and 15% polyamide. In some embodiments, the base layer 1 comprises about 30%-about 32% of the cloth "A," and the terry layer 2 comprises about 68%-about 70% of the cloth.

As shown in FIGS. 1-3, the matrix-like arrangement of the terry woven loops or units of the terry layer 2 are arranged in longitudinal lines, and the separation portions 3 are parallel to the longitudinal lines of the terry loops. As shown in FIG. 3, during the heating process, the terry woven units on both sides of the separation portions 3 melt, shrink, fuse and lodge, resulting in the terry layers 2 on both sides of the separation portions 3 gradually become thicker away from the separation portions 3.

As shown in FIGS. 1-3, the single, removable pieces "M" of textile cloth are formed by dividing the integral cloth "A" with the longitudinal separation portions 3. The width of the single pieces of cloth "M" is consistent with the width of the cloth. The length of the single pieces of cloth "M" can be, for example, about 5 cm-about 200 cm.

In the illustrated embodiment, the terry layer 2 is located on both sides of the base layer 1, respectively. The base layer 1 and the two terry layers 2 are thus heated, molten and compressed to form the separation portions 3. The separation portions 3 are located at the mid-line of the thickness of the cloth to form a recessed line or groove on both surfaces of the cloth.

In some embodiments, the separation portions or molten masses 3 have a thickness of about 0.01 mm-about 2 mm and a width of about 1 mm-about 5 mm. These thickness and widths both enable the separation portions 3 to connect the textile cloth units "M" on both sides thereof, so as to maintain the integrity of the cloth "A" prior to tearing, and provide that the connection strength is within a range that the separation portions 3 can be broken out by the user by tearing, so as to facilitate the user to separate an independent single piece of cloth "M" from the roll. Furthermore, the width range of about 1 mm-about 5 mm is such that it makes the separation portions 3 visible while the fabric is not wasted.

In addition, both side edges of the continuous polyester fiber textile cloth may be formed by edge-cutting via hot melting to prevent fraying of the yarns or threads. Further, upon tearing of a separation portion 3 to separate a cloth unit "M," part of the separation portion 3, which will not fray, remains at the newly-formed edge of the cloth "A," and functions to seal that edge and prevent fraying, as exemplarily-shown in FIG. 2.

In rolled form, the cloth "A" facilitates storage and use of the cloth. Of course, the cloth "A" may be in other configurations, such as, for example, in a folded form.

As shown in FIG. 1, the rolled cloth "A" includes an inner core 4 and the cloth "A" rolled onto the inner core 4. The inner core 4 may be, for example, a cylindrical paper core.

It should be noted that at the outer edge of the cloth formed by tearing the separation portions 3, the material is hard, thin and has a rough edge, while the outer surface of the polyester fiber textile cloth is rough due to the terry layer 2. This outer edge may provide a large friction force with the outer surface of the unheated cloth, and the edge may even prick into or catch on the terry layer 2, so that the edge can attach or adhere to the outer surface of the cloth "A," allowing the rolled cloth to maintain a stable rolled shape, without falling off or loosening.

The above describes specific examples of the invention. The description of such embodiments should only be used to help understand the invention. That is, those skilled in the art should appreciate that the descriptions of embodiments herein are only descriptive and exemplary, and should not be interpreted as limiting the scope of the invention or the claims herein. It should be noted that several improvements and modifications can be made to the disclosed embodiments by those of ordinary skill in the technical art without departing from the principles of the invention, and such that these improvements and modifications fall within the scope thereof.

What is claimed is:

1. A cloth comprising:

a continuous cloth material formed with meltable material, wherein the continuous cloth material defines an upper side, a lower side opposite the upper side, a thickness of the cloth material measured in a direction from the upper side to the lower side, a first marginal edge portion, a second marginal edge portion opposite the first marginal edge portion, and a width of the cloth material extending between the first and second marginal edge portions;

wherein the continuous cloth material includes a plurality of separation portions each extending from approximately the first marginal edge portion to the second marginal edge portion, each such separation portion is defined by melted and compressed cloth material having a substantially uniform thickness measured in a same direction as the thickness of the cloth material that is less than the thickness of the cloth material and extending substantially uninterrupted from approximately the first marginal edge portion to approximately the second marginal edge portion, the melted and compressed cloth material defines at least one of a decreased toughness or increased brittleness relative to said cloth material and has a tear strength that is less than a tear strength of said cloth material such that the melted and compressed cloth material tears more easily at the separation portion than at said cloth material, and each such separation portion is configured for adjacent cloth units on opposing sides of the separation portion to be separated from each other by tearing along such separation portion to thereby define on each of the separated adjacent cloth units an edge portion to which a portion of the melted and compressed cloth material remains attached to close or seal such edge portion and prevent fraying of said cloth material.

2. The cloth according to claim 1, wherein the cloth material at the separation portions is damaged but not broken through the thickness of the cloth material.

3. The cloth according to claim 1, wherein the separation portions are positioned to define cloth units having a length of 5 cm-200 cm.

4. The cloth according to claim 1, wherein the cloth material comprises a base layer woven from yarns and a terry layer located on an upper side and/or a lower side of the base layer, and the separation portions were formed by heating and melting and compressing the base layer and the terry layer.

5. The cloth according to claim 4, wherein the terry layer is located on both the upper and lower sides of the base layer.

6. The cloth according to claim 4, wherein said cloth material at the separation portions includes damaged but not broken fibers of the base layer and the terry layer.

7. The cloth according to claim 1, wherein said melted and compressed cloth material was heated and melted by high-frequency ultrasonic.

8. The cloth according to claim 1, wherein the separation portions are formed to define a recess or groove in the cloth material relative to adjacent unmelted cloth material.

9. The cloth according to claim 1, wherein the cloth material comprises a base layer and a looped pile layer attached to the base layer, and said substantially uniform thickness is no greater than a thickness of the base layer.

10. The cloth according to claim 1, wherein said substantially uniform thickness is 0.01-2 mm.

11. The cloth according to claim 1, wherein the separation portions define a width of 1-5 mm.

12. The cloth according to claim 1, wherein the plurality of separation portions are located at intervals along a length direction of the cloth.

13. The cloth according to claim 1, wherein the meltable material includes a polyester or polyester blend.

14. The cloth according to claim 1, wherein each of the plurality of separation portions defines a straight, curved, zigzag or bent line.

15. The cloth according to claim 1, wherein the first and second marginal edge portions define edges of the cloth along a length direction of the cloth formed by edge-cutting by hot melting.

16. The cloth according to claim 1, wherein each of the plurality of separation portions includes a molten mass extending along a length of the separation portion.

17. The cloth according to claim 1, wherein, upon said tearing, a torn separation portion defines a molten edge extending along a length thereof without fraying.

18. The cloth according to claim 1 rolled into a roll.

19. The cloth according to claim 1, wherein one of said separation portions is torn along said separation portion such that the adjacent cloth units on opposing sides of said one of said separation portions are separated from each other and define on each of the separated cloth units along the tear a respective edge portion to which and a portion of the melted and compressed cloth material remains attached to the separated adjacent cloth units.

20. A cloth comprising:

a continuous cloth material formed with woven fibers of meltable material, wherein the continuous cloth material defines an upper side, a lower side opposite the upper side, a thickness of the cloth material measured in a direction from the upper side to the lower side, a first marginal edge portion, a second marginal edge portion opposite the first marginal edge portion, and a width of the cloth material extending between the first and second marginal edge portions;

wherein the continuous cloth material includes one or more separation portions at which the cloth material is melted but not broken and extends substantially uninterrupted from the first marginal edge portion of the continuous cloth material to a to the second marginal edge portion, said melted but not broken cloth material having a thickness measured in a same direction as the thickness of the cloth material that is less than the thickness of unmelted cloth material, and each of said one or more separation portions having a tear strength that is less than a tear strength of said unmelted cloth material, such that the cloth tears more easily at the separation portions than at said unmelted cloth material, and wherein each such separation portion is configured for adjacent cloth units on opposing sides of the separation portion to be separated from each other by tearing along such separation portion to thereby define on each of the separated adjacent cloth units an edge portion to which a portion of the melted but not broken cloth material remains attached after said tearing.

21. The cloth according to claim 20, wherein the melted but not broken cloth material defines a recess or groove in the cloth relative to the unmelted cloth material.

22. The cloth according to claim 20, wherein the cloth material comprises a base layer and a looped pile layer attached to the base layer, and said thickness of said melted but not broken cloth material is no greater than a thickness of the base layer.

23. The cloth according to claim 20, wherein said thickness of said melted but not broken cloth material is 0.01-2 mm.

24. The cloth according to claim 20, wherein the melted but not broken cloth material at the separation portions is not broken through the thickness of the cloth material.

25. The cloth according to claim 20, wherein each of the one or more separation portions includes a line of melted and damaged but unbroken fibers of the meltable material.

26. The cloth according to claim 20, wherein each of the one or more separation portions includes a line of melted and compressed fibers of the meltable material having the thickness that is less than the thickness of the unmelted cloth material.

27. The cloth according to claim 26, wherein the cloth material comprises a base layer woven from yarns and a terry layer located on an upper side and/or a lower side of the base layer.

28. The cloth according to claim 26, wherein the line of melted and compressed fibers of the meltable material has the thickness that is less than the thickness of the unmelted cloth material substantially uniformly along a length of the line.

* * * * *